US009781978B1

(12) United States Patent
Lim

(10) Patent No.: US 9,781,978 B1
(45) Date of Patent: Oct. 10, 2017

(54) MALE BUTTON FOR A SNAP BUTTON

(71) Applicants: Mal Soon Shin, Goyang-si, Gyeonggi-do (KR); Jea Kwang Lim, Seoul (KR); Jeong In Im, Hanam-si, Gyeonggi-do (KR)

(72) Inventor: Hyung Chun Lim, Goyang-si (KR)

( * ) Notice: Subject to any disclaimer, the term of this patent is extended or adjusted under 35 U.S.C. 154(b) by 0 days.

(21) Appl. No.: 15/383,987

(22) Filed: Dec. 19, 2016

(51) Int. Cl.
*A44B 17/00* (2006.01)

(52) U.S. Cl.
CPC ..... *A44B 17/007* (2013.01); *A44B 17/0005* (2013.01); *A44B 17/0023* (2013.01); *A44B 17/0088* (2013.01)

(58) Field of Classification Search
CPC . A44B 17/005; A44B 17/007; A44B 17/0023; A44B 17/0088
See application file for complete search history.

(56) References Cited

U.S. PATENT DOCUMENTS

| | | | | |
|---|---|---|---|---|
| 2,798,273 | A * | 7/1957 | Meyer | A44B 1/34 24/104 |
| 3,320,644 | A * | 5/1967 | Daddona, Jr. | A44B 1/44 24/95 |
| 4,571,780 | A | 2/1986 | Fukuroi | |
| 4,890,364 | A | 1/1990 | Tanaka et al. | |
| 2011/0113600 | A1* | 5/2011 | Hasegawa | A44B 17/0023 24/594.11 |
| 2012/0246881 | A1* | 10/2012 | Miyauchi | A44B 1/44 24/113 R |
| 2015/0257494 | A1* | 9/2015 | Oakley | A44B 17/0082 273/157 R |

FOREIGN PATENT DOCUMENTS

| | | | |
|---|---|---|---|
| JP | 2007-068746 | A | 3/2007 |
| JP | 2010-042178 | A | 2/2010 |
| KR | 1985-0003010 | Y1 | 12/1985 |
| KR | 20-0183274 | Y1 | 5/2000 |
| KR | 20-0288149 | Y1 | 9/2002 |
| KR | 10-1180898 | B1 | 9/2012 |

* cited by examiner

*Primary Examiner* — David Upchurch
(74) *Attorney, Agent, or Firm* — Novick, Kim & Lee, PLLC; Jae Youn Kim

(57) ABSTRACT

A male button for a snap button is provided that can have an enhanced appearance and that can obtain an advertising effect and a decoration effect while representing a luxurious appearance and that can prevent foreign substances from being entered therein. The male button for a snap button includes: a main body having a surface portion and a press fixing portion having closed front surfaces in order to form a receiving space within a fitting protrusion and a concave peripheral portion protruded in a cylindrical shape; a deformation prevention device received at the receiving space of the main body; a snap having a coupling rod and fixed to the press fixing portion of the main body; and a snap fixing plate inserted and fixed to the coupling rod of the snap.

4 Claims, 8 Drawing Sheets

MALE BUTTON FOR A SNAP BUTTON

CROSS-REFERENCE TO RELATED APPLICATIONS

This application claims priority to Korean Patent Application No. 10-2015-0145393, filed on Oct. 19, 2015, the disclosure of which is incorporated herein by reference in its entirety.

BACKGROUND OF THE INVENTION

Field of the Invention

The present invention relates to a male button for a snap button, and more particularly, to a male button for a snap button that can have an enhanced appearance and that can obtain an advertising effect and decoration effect while representing a luxurious appearance and that can prevent foreign substances from being entered therein.

Description of the Related Art

In general, in order to fasten two materials used in a product such as a garment, a bag, or footwear, a pair of buttons such as press buttons or snap buttons are installed at the materials facing each other, and when an external force is applied to the pair of buttons, opposite surfaces thereof may be fastened to each other.

As shown in FIG. 1, a conventional snap button includes a female button 10*a* and a male button 10*b* that may be coupled or separated, is formed in a structure having snaps 20*a* and 20*b* for fixing the female button 10*a* and the male button 10*b*, respectively, to a fabric, while coupling holes 12*a* and 12*b* are formed at the center of the female button 10*a* and the male button 10*b*, respectively, and the snaps 20*a* and 20*b* are formed in a structure having cylindrical coupling rods 22*a* and 22*b* passing through the coupling holes 12*a* and 12*b*, respectively. In this case, at the inner side of the female button 10*a*, the snap button houses an elastic ring that contacts with an outer periphery of a fitting protrusion formed in the male button 10*b* to prevent the male button 10*b* from being separated.

In a process of attaching such a conventional snap button to a garment, a bag and footwear, a location to fix the female button 10*a* and the male button 10*b* is marked at a fabric of the garment, the bag, and the footwear, a hole is formed by a punch at the marking location, the coupling rods 22*a* and 22*b* of the snaps 20*a* and 20*b* are inserted into the hole, the coupling holes 12*a* and 12*b* of the female button 10*a* and the male button 10*b* are fitted to the coupling rods 22*a* and 22*b* of the snaps 20*a* and 20*b*, respectively, the coupling rods 22*a* and 22*b* of the snaps 20*a* and 20*b* protruded onto the coupling holes 12*a* and 12*b* are struck by the punch, the coupling rods 22*a* and 22*b* are extended and come in close contact with the coupling holes 12*a* and 12*b* and thus the female button 10*a* and the male button 10*b* each are fixed to the fabric.

Therefore, when coupling them, the fitting protrusion of the male button 10*b* is located to correspond to the coupling hole 12*a* formed in the female button 10*a*, and when the male button 10*b* is pressed toward the female button 10*a*, while the fitting protrusion is inserted into the coupling hole 12*a*, an elastic ring received in the female button 10*a* is pulled by an end portion of the fitting protrusion and is located and pressed at a concave peripheral portion of the fitting protrusion and comes in close contact with an outer periphery of the fitting protrusion and thus the female button 10*a* and the male button 10*b* are integrally coupled. When separating the snap button, if the fabric to which the female button 10*a* is fixed is pulled, the fitting protrusion is separated from the elastic ring to be conveniently separated therefrom. Even if a coupling location of such a female button 10*a* and male button 10*b* is installed on the contrary, the same operation may be performed. A detailed description of such a snap button is described in Korean Registered Utility Model Nos. 20-0183274 and 20-0288149.

However, as shown in FIG. 1, in the male button 10*b* for the conventional snap button, because the coupling hole 12*b* is exposed to the outside in a state in which the male button 10*b* is separated from the female button 10*a*, there is a problem that the male button 10*b* does not structurally have an enhanced appearance and therefore the male button 10*b* may not represent a luxurious appearance.

Further, because the coupling hole 12*b* of the conventional snap button is formed in a central portion of the male button 10*b*, the conventional snap button has a structure in which a pattern, etc., may not be formed on a surface thereof and thus an advertising effect and a decoration effect may not be obtained and quality of the snap button may thus be deteriorated.

In the conventional male button 10*b*, because foreign substances are easily entered into the male button 10*b* through the coupling holes 12*a* and 12*b*, there is a problem that products in which the conventional snap buttons are used may be contaminated.

SUMMARY OF THE INVENTION

The present invention has been made in view of the above problems and provides a male button for a snap button having an enhanced appearance by improving a structure thereof such that the inside of the male button is not exposed to the outside.

The present invention further provides a male button for a snap button that can obtain an advertising effect and a decoration effect while representing a luxurious appearance by forming various patterns or logos on a surface of the male button, thereby enhancing marketability.

The present invention further provides a male button for a snap button that can prevent foreign substances from being entered into the male button to prevent products in which the snap buttons are used from being contaminated.

In accordance with an aspect of the present invention, there is provided a male button for a snap, wherein a closed surface portion is formed at a front surface of a main body and a press fixing portion is formed at an edge of the main body in order to form a receiving space within a fitting protrusion and a concave peripheral portion protruded in a cylindrical shape, the receiving space of the main body receives a deformation prevention device that prevents the fitting protrusion and the concave peripheral portion from being dented upon performing a compression work for fixing the male button to a fabric, a snap having a coupling rod is inserted and fixed by compressing to a press fixing portion of the main body, and a snap fixing plate is inserted and fixed by compressing to a coupling rod of the snap.

Further, in the present invention, at the surface portion of the main body, various patterns or logos are formed.

Further, in the present invention, at the surface portion of the main body, a pattern is formed by intaglio or embossment.

Further, in the present invention, the deformation prevention portion is made of a metal that is not dent or broken upon performing a compression work.

Further, in the present invention, at both sides of the snap, a discharge hole is formed to discharge a plating liquid.

Further, in the present invention, a fixing cap is inserted and fixed by compression to the coupling rod of the snap.

Advantageous Effects

According to a male button for a snap button of the present invention, because a closed surface portion is integrally formed at a front surface of a main body, the inside of the male button is not exposed to the outside and thus the appearance of the male button is enhanced.

Further, because various patterns or logos are formed on a surface portion of the main body by intaglio or embossment, the male button can structurally represent a luxurious appearance and obtain an advertising effect and a decoration effect and marketability can be thus enhanced.

Further, because foreign substances can be prevented from being entered into the male button through a closed surface portion of the main body, products in which the snap buttons are used can be prevented from being contaminated.

DETAILED DESCRIPTION OF EXEMPLARY EMBODIMENTS

Figure 1:
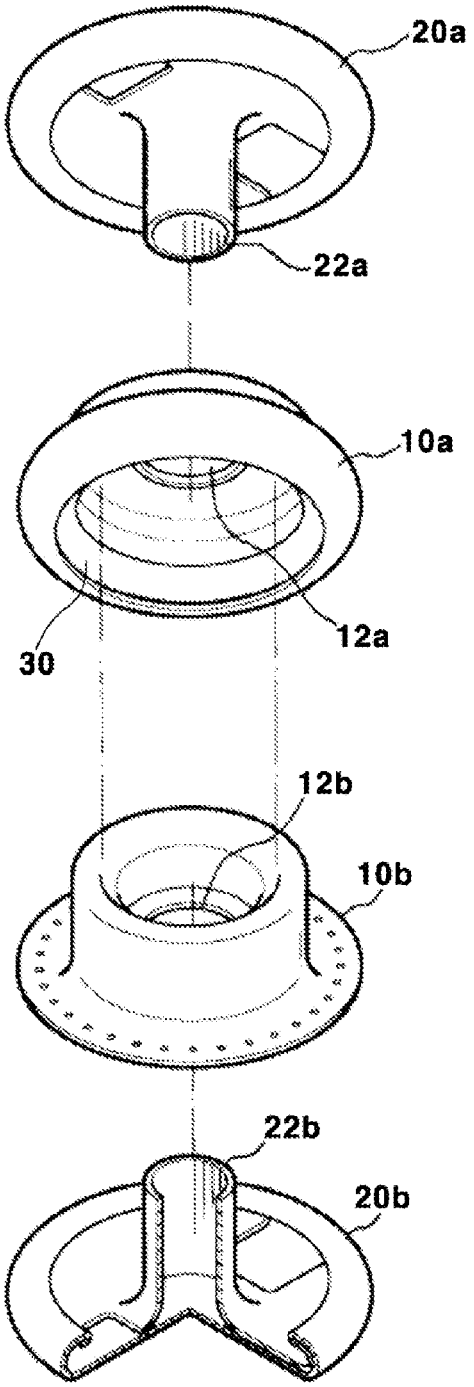
PRIOR ART FIG. 1
FIG. 1 is an exploded perspective view illustrating a conventional snap button.
Figure 2:
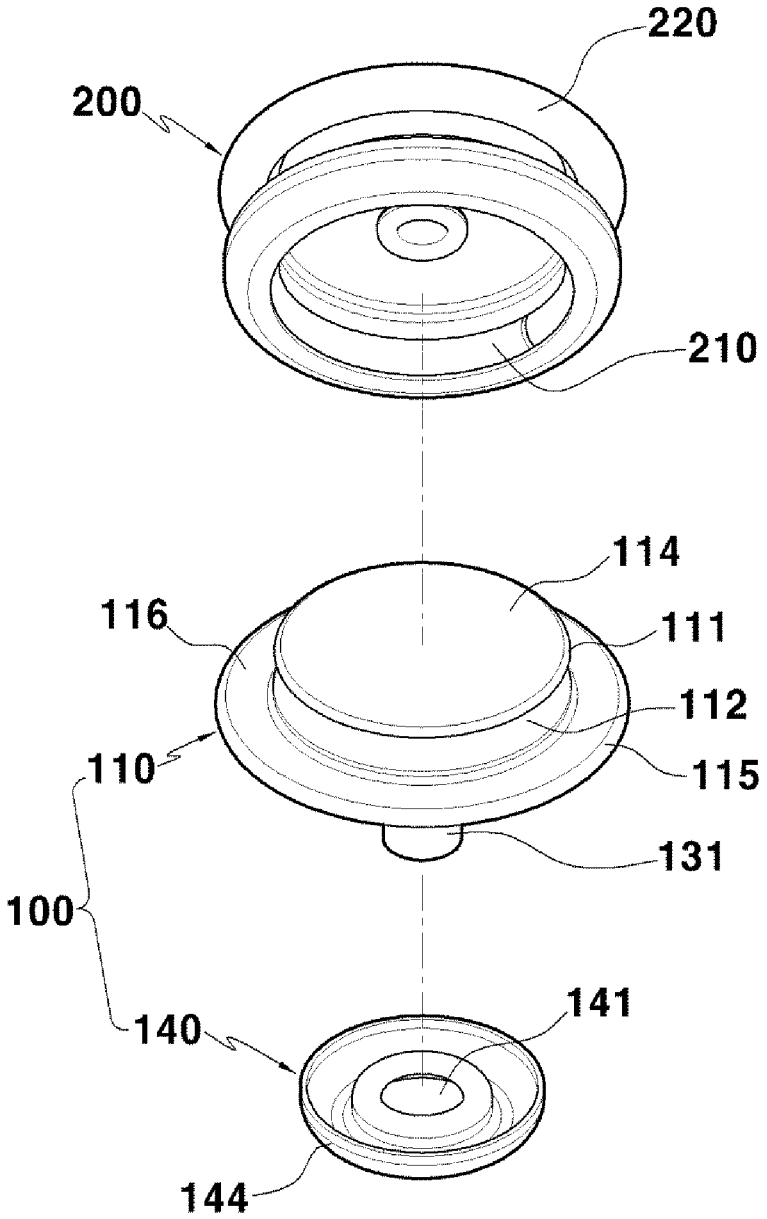
FIG. 2 is an exploded perspective view illustrating a snap button according to an exemplary embodiment of the present invention.

Hereinafter, a configuration according to an exemplary embodiment of the present invention will be described in detail with reference to the attached drawings.

As shown in FIGS. 2 to 9, a male button 100 for a snap button according to an exemplary embodiment of the present invention includes a main body 110 having a surface portion 114 and a press fixing portion 115 having a closed front surface in order to form a receiving space 113 within a fitting protrusion 111 and a concave outer peripheral portion 112 protruded in a cylindrical shape; a deformation prevention device 120 received in the receiving space 113 of the main body 110; a snap 130 having a coupling rod 131 and fixed to the press fixing portion 115 of the main body 110; and a snap fixing plate 140 inserted and fixed to the coupling rod 131 of the snap.

Here, the male button 100 is coupled separably to a female button 200 of the snap button, and such a male button 100 includes a main body 110, a deformation prevention device 120, a snap 130, and a snap fixing plate 140. In this case, the main body 110, the snap 130, and the snap fixing plate 140 are produced by shaping a thin metal piece.

The male button 100 and the female button 200 form the snap button and are installed at opposite locations on an opening portion in order to close the opening portion formed in a product such as garment, a bag or footwear, and when an external force is applied, the male button 100 and the female button 200 are formed such that opposite surfaces are fitted to each other. In this case, at the inner side of the female button 200, an elastic ring 210 is formed that contacts an outer periphery of the fitting protrusion 111 formed in the main body 110 of the male button 100 to prevent the male button 100 from being separated, and a snap 220 for fixing the female button 200 to a fabric 300 is coupled to the outside of the female button 200.

The main body 110 forms a body of the male button 100, and at a central portion of such a main body 110, the fitting protrusion 111 and the concave peripheral portion 112 coupled to the elastic ring 210 of the female button 200 are protruded in a cylindrical shape, and the receiving space 113 is formed to receive the deformation prevention device 120 within the concave peripheral portion 112 and the fitting protrusion 111. A front surface of the receiving space 113 is closed by the surface portion 114, and at an edge of the main body 110, the press fixing portion 115 is formed to fix the snap 130. In this case, at a front surface of the main body 110, because the surface portion 114 is integrally formed, the inside of the male button 100 is not exposed to the outside and thus the male button 100 has an enhanced appearance and prevents foreign substances from being entered therein.

The fitting protrusion 111, the concave peripheral portion 112, the surface portion 114, and the press fixing portion 115 of the main body 110 are integrally formed through a thin metal piece. A connection portion 116 is integrally formed between the concave peripheral portion 112 and the press fixing portion 115. In this case, at an inner side of the press fixing portion 115, a space 115*a* is formed to receive the snap 130, and upon performing a compression work of the press fixing portion 115, an inner surface of the connection portion 116 supports the snap 130.

Figure 7A:
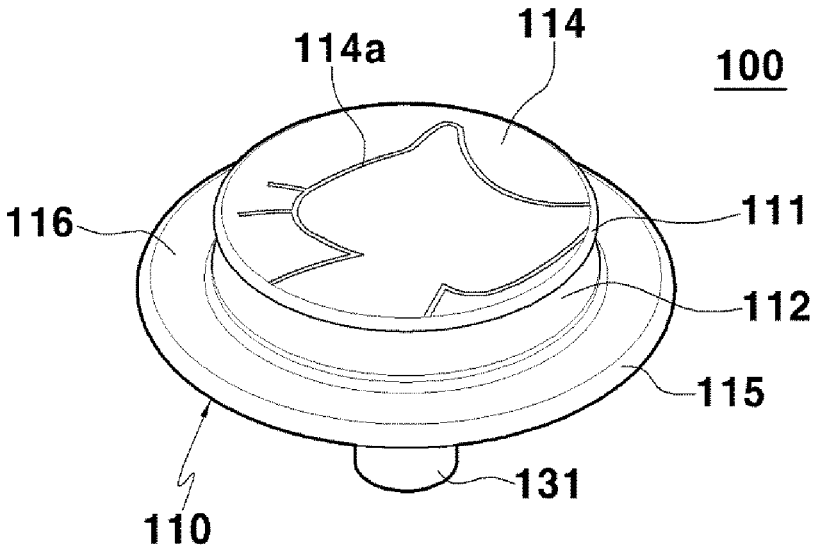
FIGS. 7A and 7B are perspective views illustrating a pattern of a surface portion according to an exemplary embodiment of the present invention.
Figure 7B:
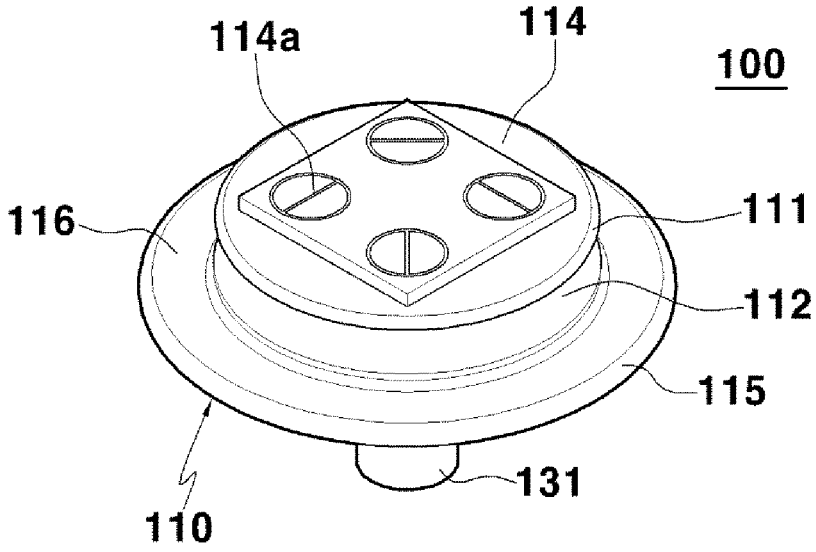

According to an exemplary embodiment of the present invention, as shown in FIGS. 7A and 7B, it is characterized in that a pattern 114*a* is formed at the surface portion 114 of the main body 110. In this case, at the surface portion 114 of the main body 110, because various patterns 114*a* or logos may be formed, a luxurious appearance of the male button can be structurally represented through the pattern 114*a* and an advertising effect and a decoration effect can be obtained.

Further, according to an exemplary embodiment of the present invention, it is characterized in that the pattern 114*a* of the surface portion 114 is formed by intaglio or embossment. In this case, as shown in FIG. 7A, the pattern 114*a* may be formed by intaglio, and as shown in FIG. 7B, the pattern 114*a* may be formed by embossment.

Figure 5:
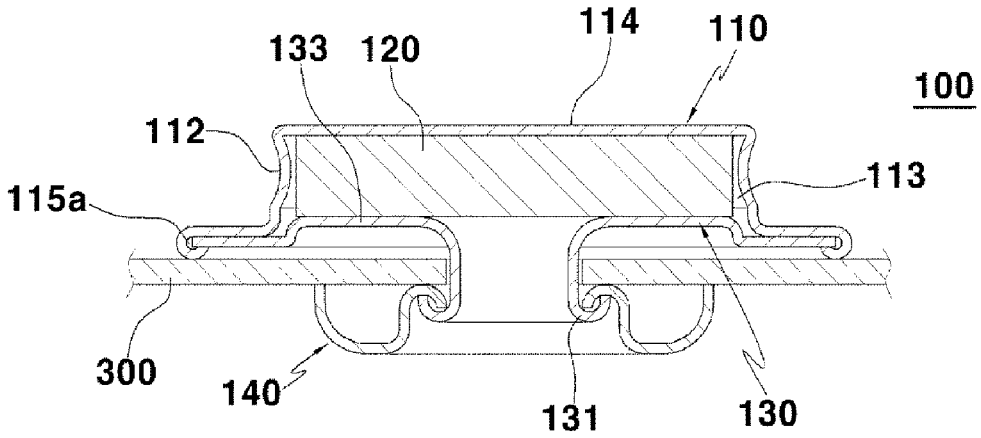
FIG. 5 is a cross-sectional view illustrating a coupled state of a male button according to an exemplary embodiment of the present invention.

The deformation prevention device 120 is housed at the receiving space 113 of the main body 110. As shown in FIG. 5, such a deformation prevention device 120 performs a function of preventing the fitting protrusion 111 and the concave peripheral portion 112 from being dented upon performing a compression work for fixing the male button 100 to the fabric 300.

According to an exemplary embodiment of the present invention, in order to prevent the fitting protrusion 111 and the concave peripheral portion 112 from being dented or broken upon performing a compression work, it is characterized in that the deformation prevention device 120 is made of a metal.

The snap 130 is fixed to the press fixing portion 115 of the main body 110 and has a coupling rod 131 for fixing the snap fixing plate 140. In this case, the snap fixing plate 140 and the coupling rod 131 are integrally formed through a thin metal piece, and the coupling rod 131 is formed in a hollow shape.

As shown in FIG. 5, in a state in which the snap 130 is inserted into the space 115*a* of the press fixing portion 115, the snap 130 is fixed by compression. In this case, as shown in FIG. 5, an end portion of the press fixing portion 115 is compressed while winding in a circle shape to come in close contact with an edge of the snap 130 and thus the snap 130 is securely fixed in a state inserted into the space 115*a* of the press fixing portion 115.

Figure 3:
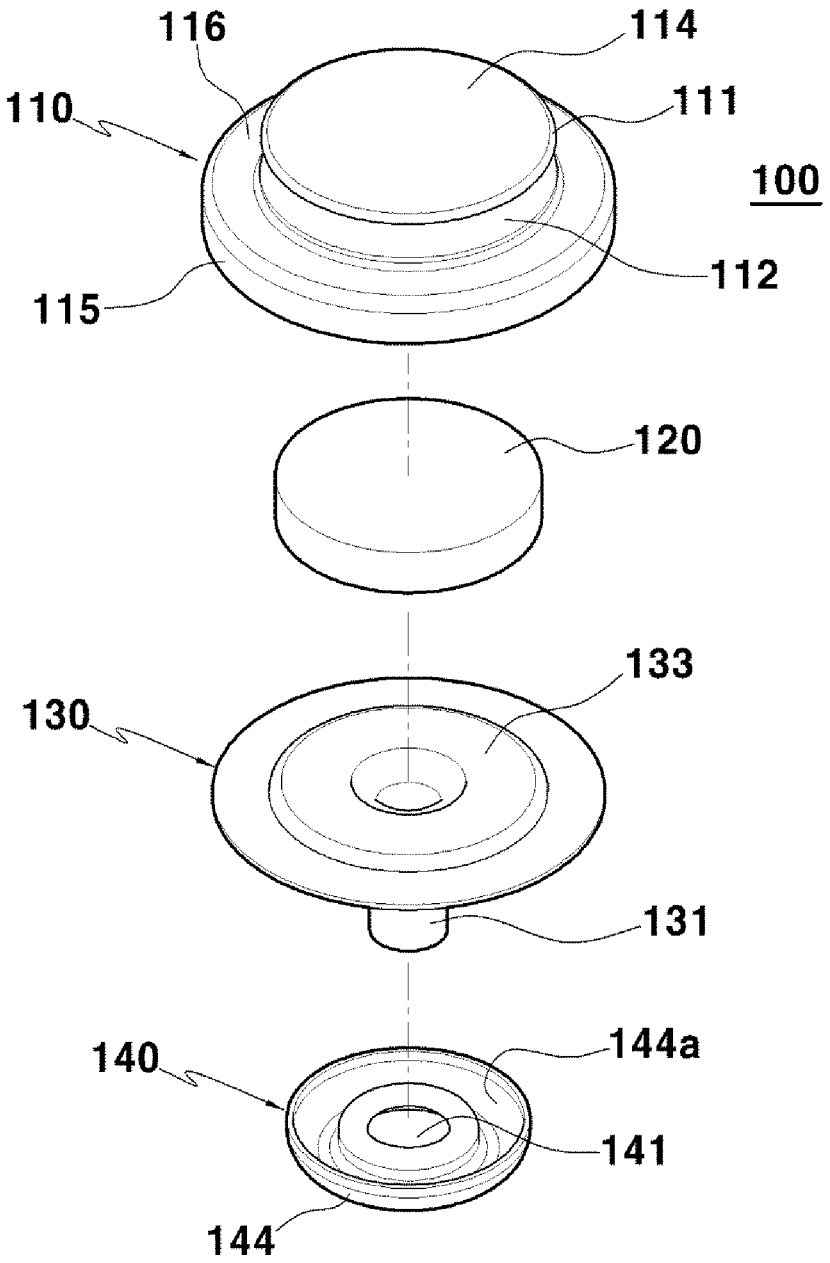
FIG. 3 is an exploded perspective view illustrating a male button according to an exemplary embodiment of the present invention.

According to an exemplary embodiment of the present invention, as shown in FIG. 3, the snap 130 is formed in a circular shape corresponding to the press fixing portion 115.

Figure 8A:
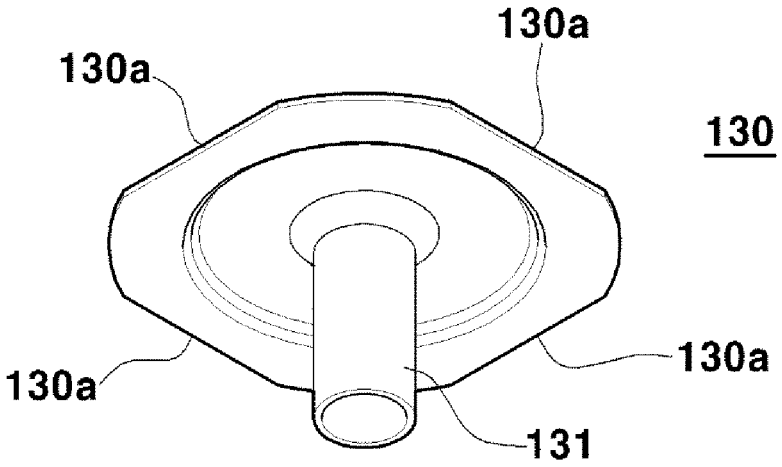
FIGS. 8A and 8B are perspective views illustrating another example of a snap according to an exemplary embodiment of the present invention.

According to another exemplary embodiment of the present invention, as shown in FIG. 8A, at four side edges of the snap 130, straight line portions 130*a* may be formed.

Figure 8B:
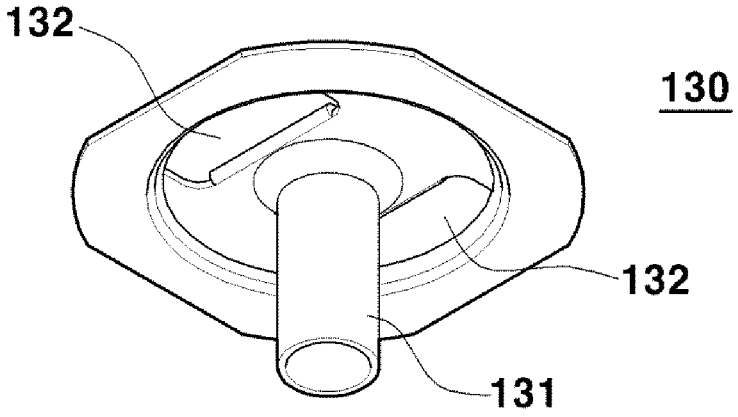

Further, according to another exemplary embodiment of the present invention, as shown in FIG. 8B, at both sides of the snap 130, it is characterized in that a discharge hole 132 is formed. In this case, upon plating the male button 100, the discharge hole 132 performs a function of discharging a plating liquid entered into the male button 100 to the outside.

In the snap 130, a movement prevention circle jaw 133 inserted into the receiving space 113 of the main body 110 is protruded. In this case, the circle jaw 133 is inserted into the receiving space 113 and prevents a movement of the snap 130 upon performing a compression work that fixes the snap 130 to the press fixing portion 115 of the main body 110.

According to an exemplary embodiment of the present invention, the main body 110 and the snap 130 may be integrally formed using die casting, if necessary.

Figure 4:
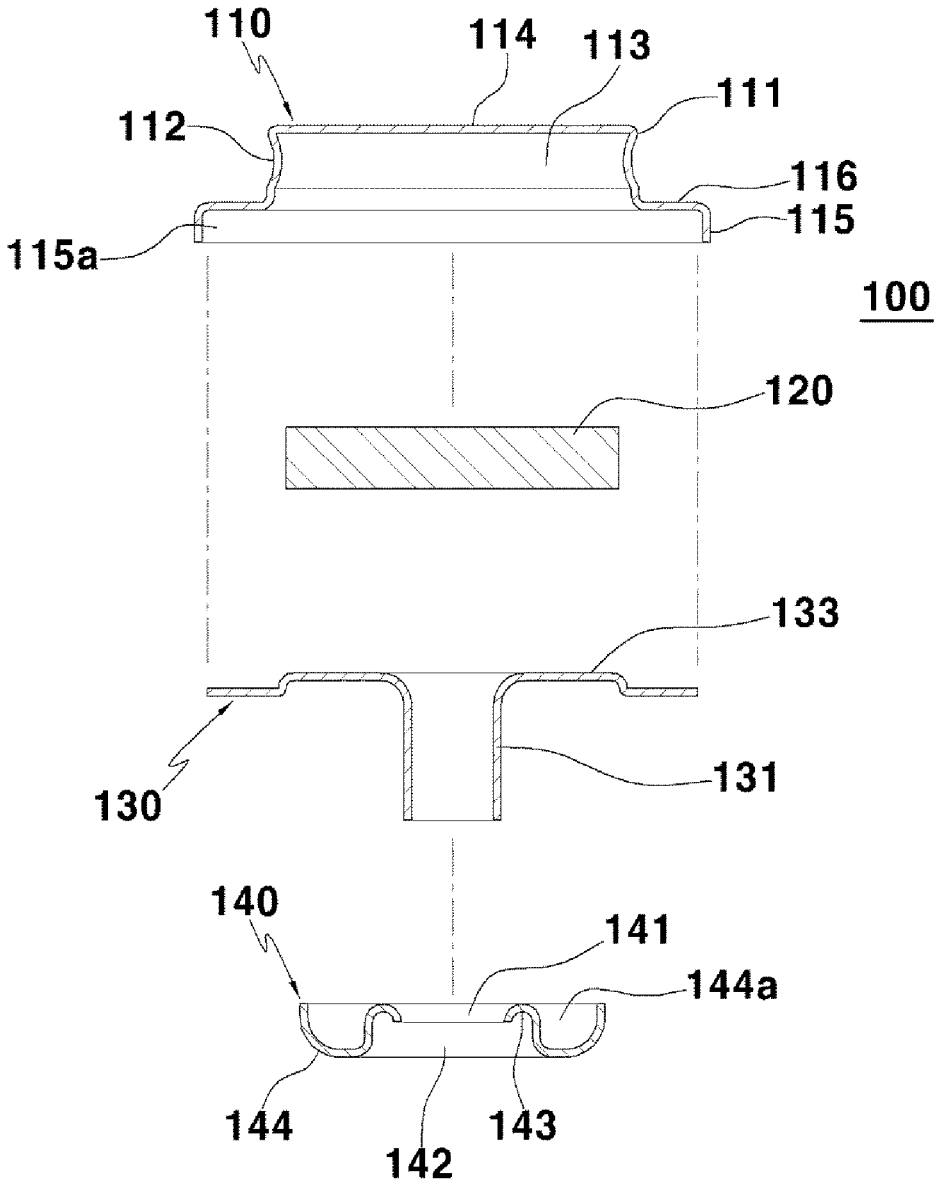
FIG. 4 is an exploded cross-sectional view illustrating a male button according to an exemplary embodiment of the present invention.

The snap fixing plate 140 is inserted and fixed to the coupling rod 131 of the snap 130, and at a central portion thereof, an insertion hole 141 inserted into the coupling rod 131 is formed. In this case, as shown in FIG. 4, in the central portion of the snap fixing plate 140, a groove 142 and a latch jaw 143 are formed, and at an edge of the snap fixing plate 140, a round rim 144 having a concave groove 144*a* is provided.

Figure 6:
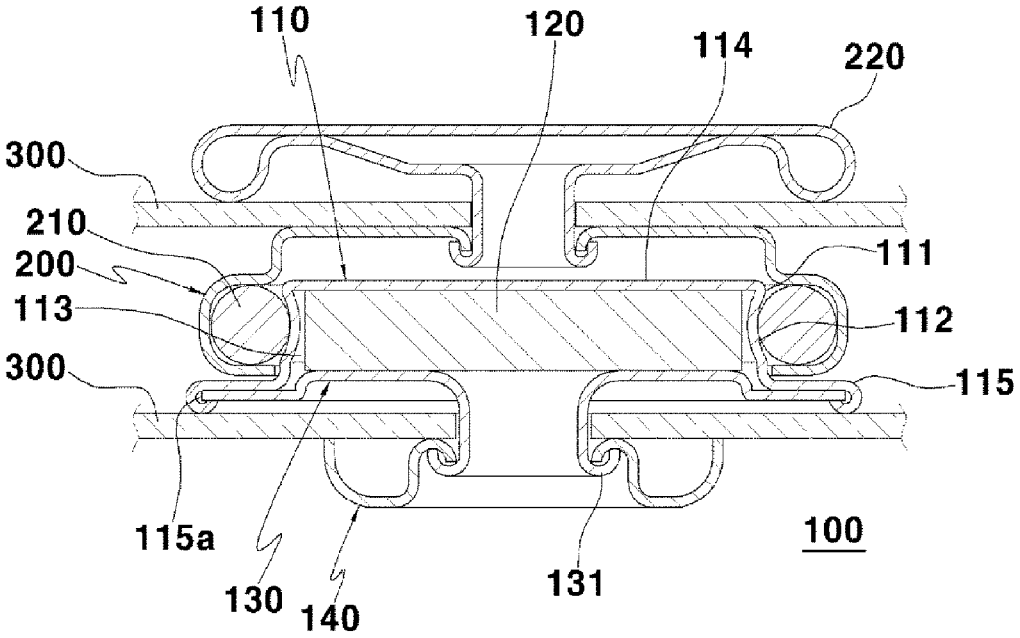
FIG. 6 is a cross-sectional view illustrating a coupled state of a snap button according to an exemplary embodiment of the present invention.

As shown in FIG. 5, in a process of attaching the male button 100 according to an exemplary embodiment of the present invention to the fabric 300 of a garment, a bag and footwear, a location to fix the male button 100 is marked to the fabric 300 of the garment, the bag and the footwear, a hole is formed by a punch at a marking location, the coupling rod 131 of the snap 130 is inserted into the hole, the insertion hole 141 of the snap fixing plate 140 is inserted into the coupling rod 131 of the snap 130 inserted and protruded to the hole of the fabric 300, and by striking the coupling rod 131 of the snap 130 by the punch, when an end portion of the coupling rod 131 is extended to and comes in close contact with the latch jaw 143 of the snap fixing plate 140, the male button 100 is securely fixed to the fabric 300. As shown in FIG. 6, the female button 200 of the snap button is disposed and securely fixed to the fabric 300 of a location opposite to the male button 100.

As described above, in a state in which the male button 100 faces the female button 200, each of them are fixed to the fabrics 300 facing each other, when pressing the male button 100 and the female button 200 together, while the fitting protrusion 111 is inserted into the female button 200, the elastic ring 210 is pulled by an end portion of the fitting protrusion 111 and is located at the concave peripheral portion 112 of the fitting protrusion 111 to be pressed and to come in close contact with an outer periphery of the fitting protrusion 111 and thus the male button 100 and the female button 200 are integrally coupled, as shown in FIG. 6. As described above, in a state in which the snap button is coupled, when each of the male button 100 and the female button 200 is pulled in opposite directions, the fitting protrusion 111 is separated from the elastic ring 210 and thus the male button 100 and the female button 200 are simply separated.

Figure 9:
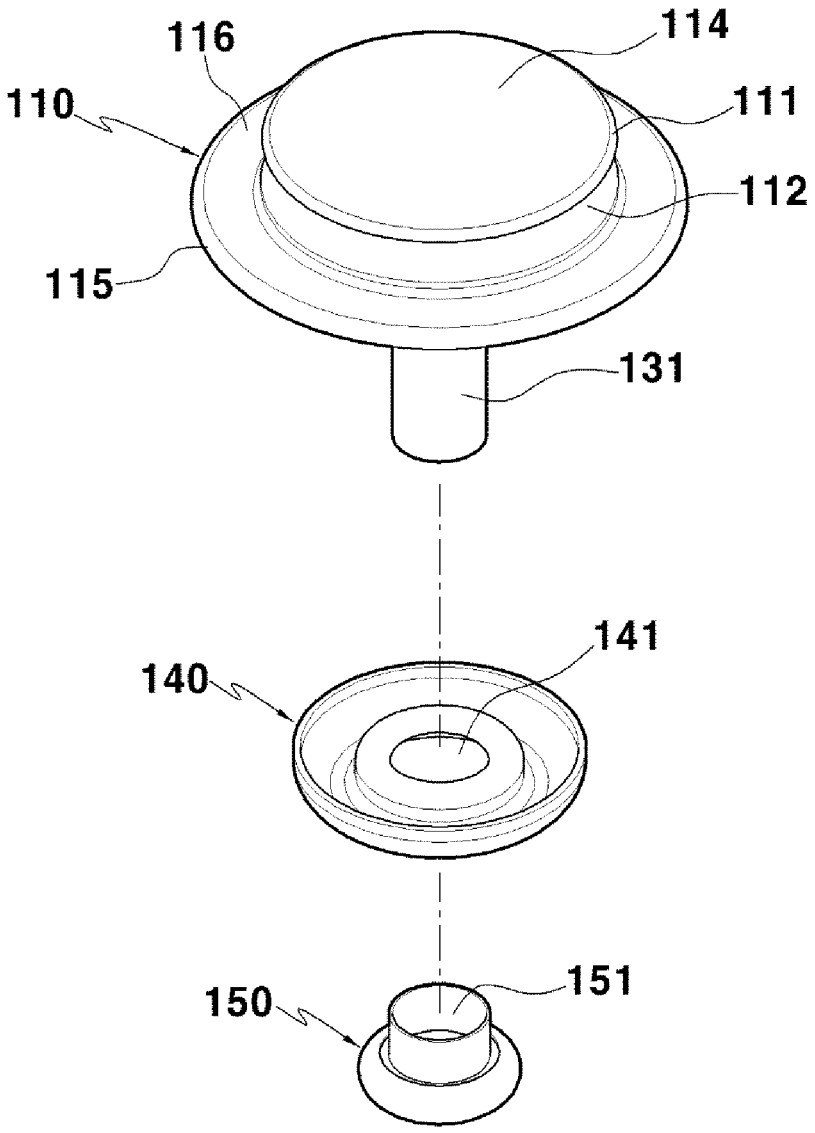
FIG. 9 is an exploded perspective view illustrating a snap button according to another exemplary embodiment of the present invention.

According to another exemplary embodiment of the present invention, as shown in FIG. 9, a fixing cap 150 is inserted and fixed by compression to the coupling rod 131 of the snap 130. According to another exemplary embodiment of the present invention, in a state in which the coupling rod 131 of the snap 130 is inserted into a coupling hole 151 formed in the fixing cap 150, the coupling rod 131 is securely fixed to the coupling hole 151 through compression and is not exposed to the outside by the fixing cap 150.

Therefore, in the present invention, because the closed surface portion 114 is integrally formed at a front surface of the main body 110, the inside of the male button 100 is not exposed to the outside and thus there is an advantage that the appearance of the male button is enhanced.

Further, in the present invention, because the various patterns 114*a* or logos are formed at the surface portion 114 of the main body 110 by intaglio or embossment, the male button 100 can structurally represent a luxurious appearance and obtain an advertising effect and a decoration effect and marketability can be thus enhanced.

In the present invention, because foreign substances can be prevented from being entered into the male button 100 through the surface portion 114 of the closed main body 110, a product in which the snap button is used can be prevented from being contaminated.

What is claimed is:

1. A male button for a snap button comprising:

a main body having a surface portion and a press fixing portion having closed front surfaces in order to form a receiving space within a fitting protrusion and a concave peripheral portion protruded in a cylindrical shape;

a deformation prevention device received at the receiving space of the main body;

a snap fixed to the press fixing portion of the main body; and a snap fixing plate fixed to the snap, wherein a coupling rod for fixing the snap fixing plate is provided at the snap, a movement prevention circle jaw inserted into the receiving space of the main body is protruded to the snap, and a discharge hole is formed at both sides of the snap.

2. The male button of claim 1, wherein a pattern is formed at the surface portion of the main body by intaglio or embossment.

3. The male button of claim 1, wherein the deformation prevention device prevents the fitting protrusion and the concave peripheral portion from being dented upon performing a compression work for fixing the male button to a fabric and is made of a metal to prevent from being dented or broken upon performing a compression work.

4. The male button of claim 1, wherein the coupling rod of the snap is securely fixed through compression in a state in which the coupling rod of the snap is inserted into a coupling hole formed in a fixing cap, and the coupling rod is not exposed to the outside by the fixing cap.

* * * * *